US008074297B2

(12) United States Patent
Graham

(10) Patent No.: US 8,074,297 B2
(45) Date of Patent: Dec. 13, 2011

(54) HEADWEAR GARMENT

(76) Inventor: Shannon L. Graham, Penrose, CO (US)

( * ) Notice: Subject to any disclaimer, the term of this patent is extended or adjusted under 35 U.S.C. 154(b) by 0 days.

(21) Appl. No.: 12/212,012

(22) Filed: Sep. 17, 2008

(65) Prior Publication Data

US 2010/0064418 A1 Mar. 18, 2010

(51) Int. Cl.
*A42B 1/00* (2006.01)

(52) U.S. Cl. ..... 2/206; 2/202; 2/171; 2/174

(58) Field of Classification Search ..... 2/202, 206, 2/174, 173, 171, 10, 410
See application file for complete search history.

(56) References Cited

U.S. PATENT DOCUMENTS 2,831,197 A * 4/1958 Spells ..... 2/203
2,897,510 A * 8/1959 Forbes-Robinson ..... 2/172
3,040,336 A * 6/1962 Plank ..... 4/521
5,875,493 A * 3/1999 MacDonald et al. ..... 2/172
5,878,756 A * 3/1999 Bilodeau ..... 132/274
6,665,876 B1 * 12/2003 Newman ..... 2/59
2003/0221243 A1 * 12/2003 Phillips ..... 2/202
2006/0179544 A1 * 8/2006 Knievel ..... 2/181
2009/0151048 A1 * 6/2009 Laury ..... 2/202

* cited by examiner

*Primary Examiner* — Khoa Huynh
*Assistant Examiner* — Alissa Tompkins

(57) ABSTRACT

A headwear garment is used for retaining a wearer's hair. The headwear garment has a head covering and a hair retaining sleeve. The head covering is open on one side for allowing a wearer to wear the head covering. The head covering has inner and outer surfaces with a channel formed through the inner and outer surfaces. The hair retaining sleeve has an opening formed in one end. The sleeve is affixed to the head covering and positioned to align the opening in the sleeve with the channel through the inner and outer surfaces of the head covering. When the head covering is worn by a wearer, the wearer's hair is able to be passed through the channel and into the sleeve through the opening.

9 Claims, 5 Drawing Sheets

HEADWEAR GARMENT

BACKGROUND

Long hair is often difficult to manage in windy situations, such as riding a motorcycle. One solution is to put the hair up and pin it tightly down. For people not wanting to do so, a better solution is needed.

DETAILED DESCRIPTION

Figure 1:
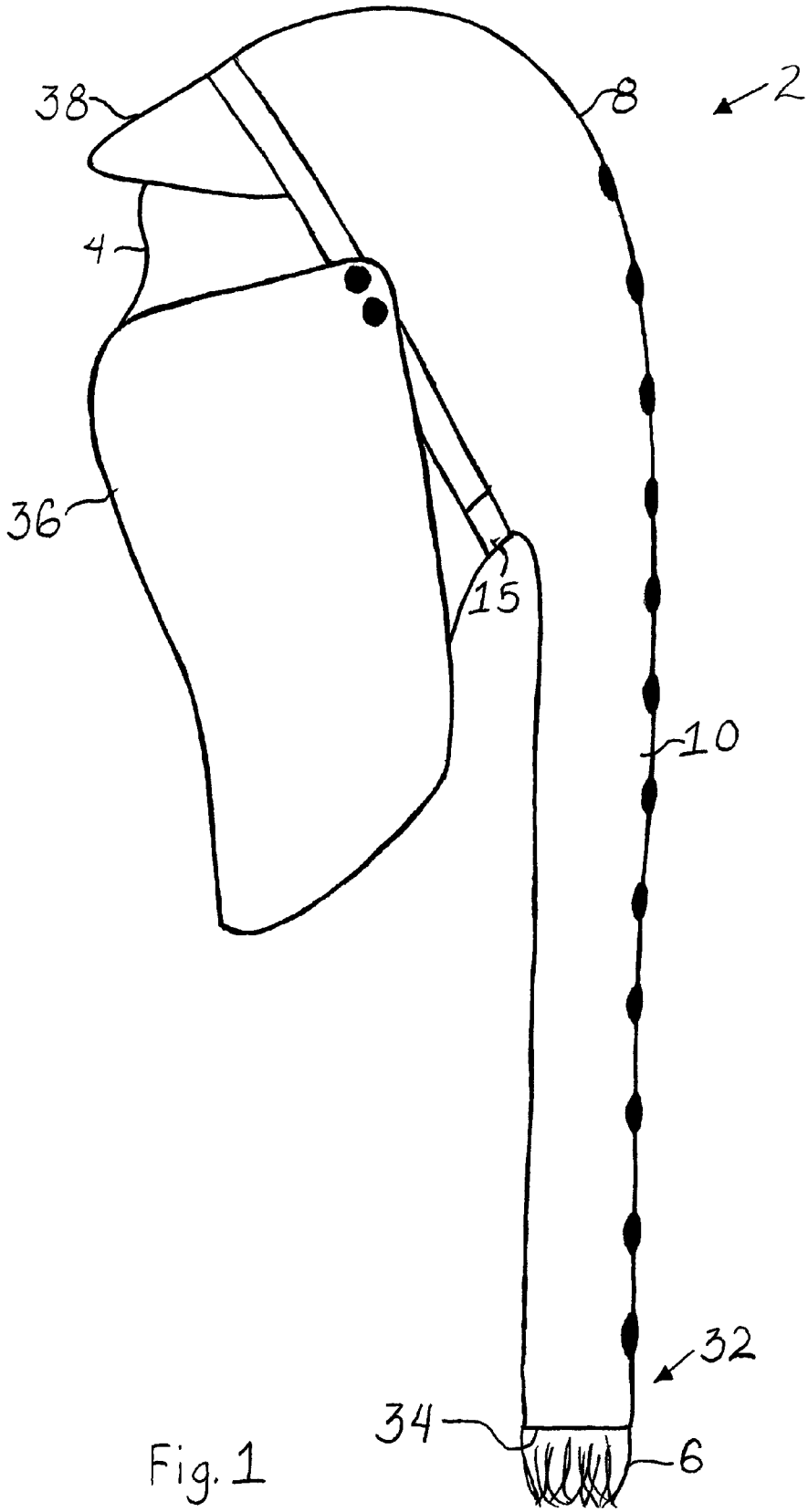
FIG. 1 is a side view of a headwear garment according to one embodiment.
Figure 2:
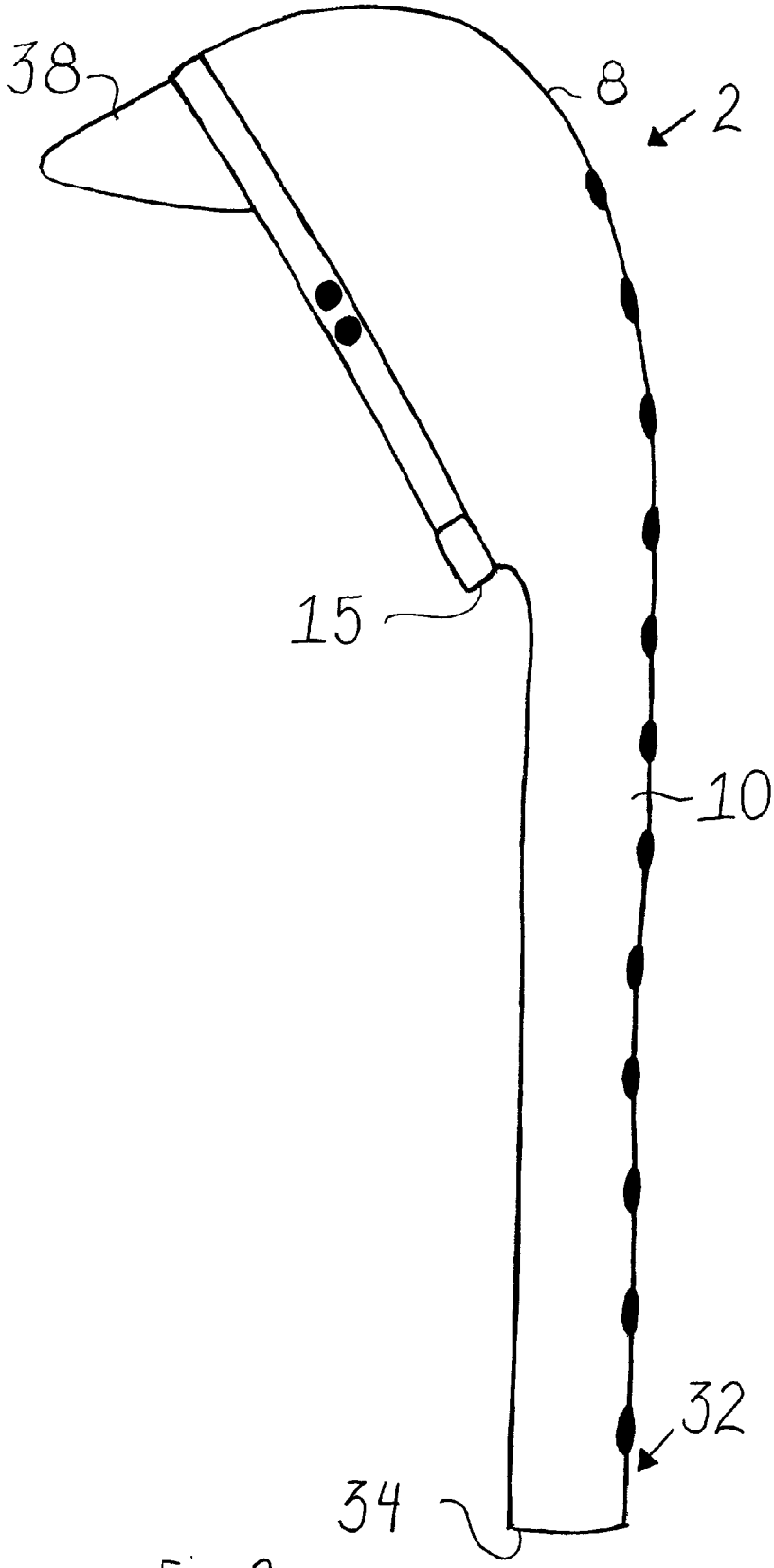
FIG. 2 is the same side view of the headwear garment as FIG. 1, but shown without a face cover and wearer.

FIGS. 1 and 2 illustrate a headwear garment 2 for retaining a wearer's 4 hair 6. Headwear garment 2 includes head covering 8 and hair retaining sleeve 10. Headwear garment 2 may be constructed of any material suitable for headwear, such as leather, solid fabric, and lace fabric. Each of the components of headwear garment 2 may be constructed of the same material or of different materials.

Figure 3:
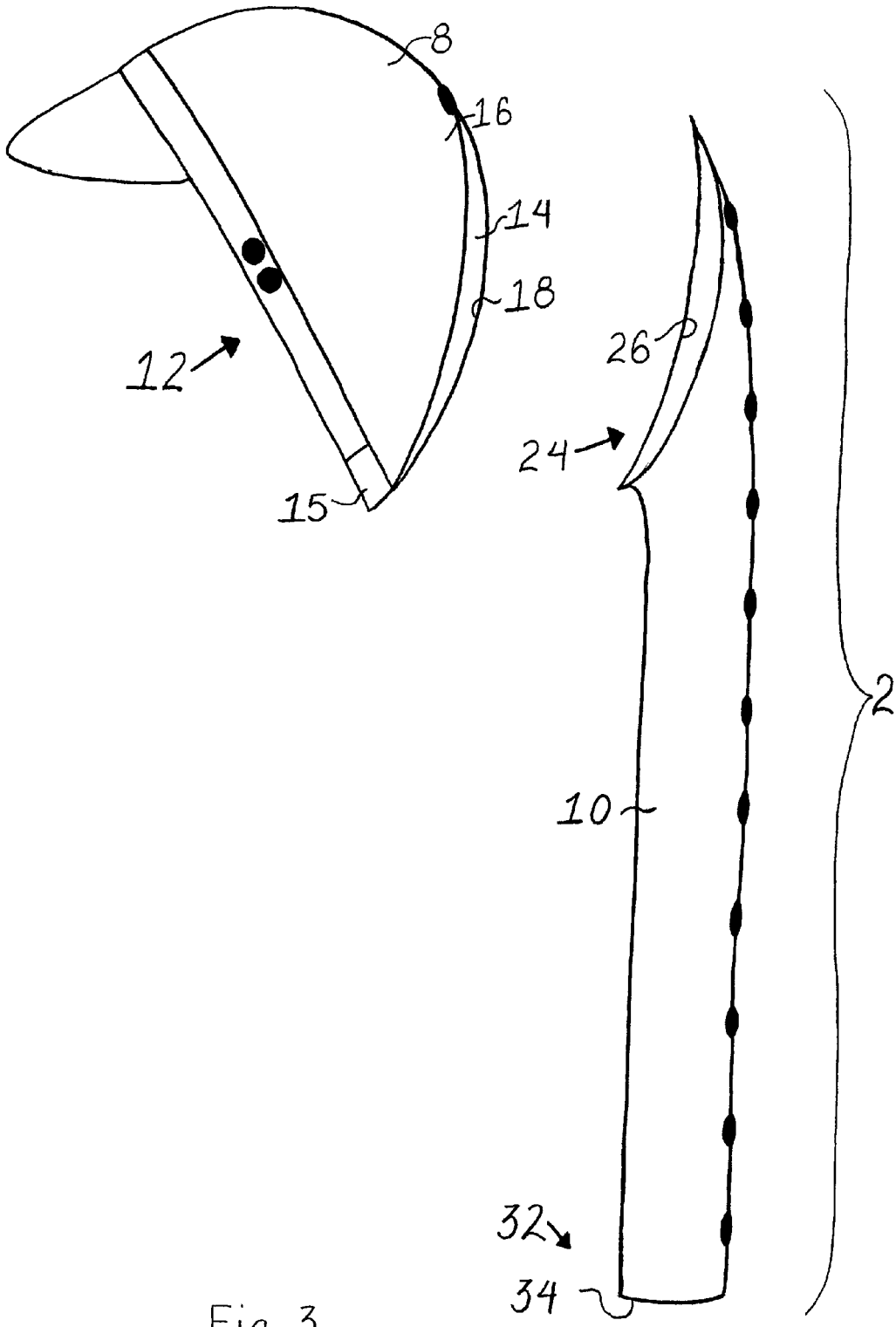
FIG. 3 is an exploded side view of the headwear garment of FIG. 1.

FIG. 3 illustrates an exploded view of headwear garment 2, including head covering 8 and sleeve 10. Head covering 8 is any type of head covering, such as a hat or cap. Head covering 8 is open on one side or first opening 12 for allowing wearer 4 to wear head covering 8. Head covering 8 has inner 14 and outer 16 surfaces with channel 18 formed through inner 14 and outer 16 surfaces.

In one embodiment, channel 18 is formed opposite open side 12 of head covering 8. Channel 18 may be formed directly opposite open side 12 of head covering 8 or generally opposite open side 12.

In one embodiment, head covering 8 includes size adjuster 15. Size adjuster 15 is any means permitting the size of head covering 8 to be adjusted so that it fits wearer's 4 head. In windy environments, it is often necessary for headwear to fit tightly so that it remains in place on wearer's 4 head. Examples of size adjuster 15 include elastic bands, and closure systems such as ties, buckles, snaps, buttons, and hook and loop fasteners.

Figure 4:
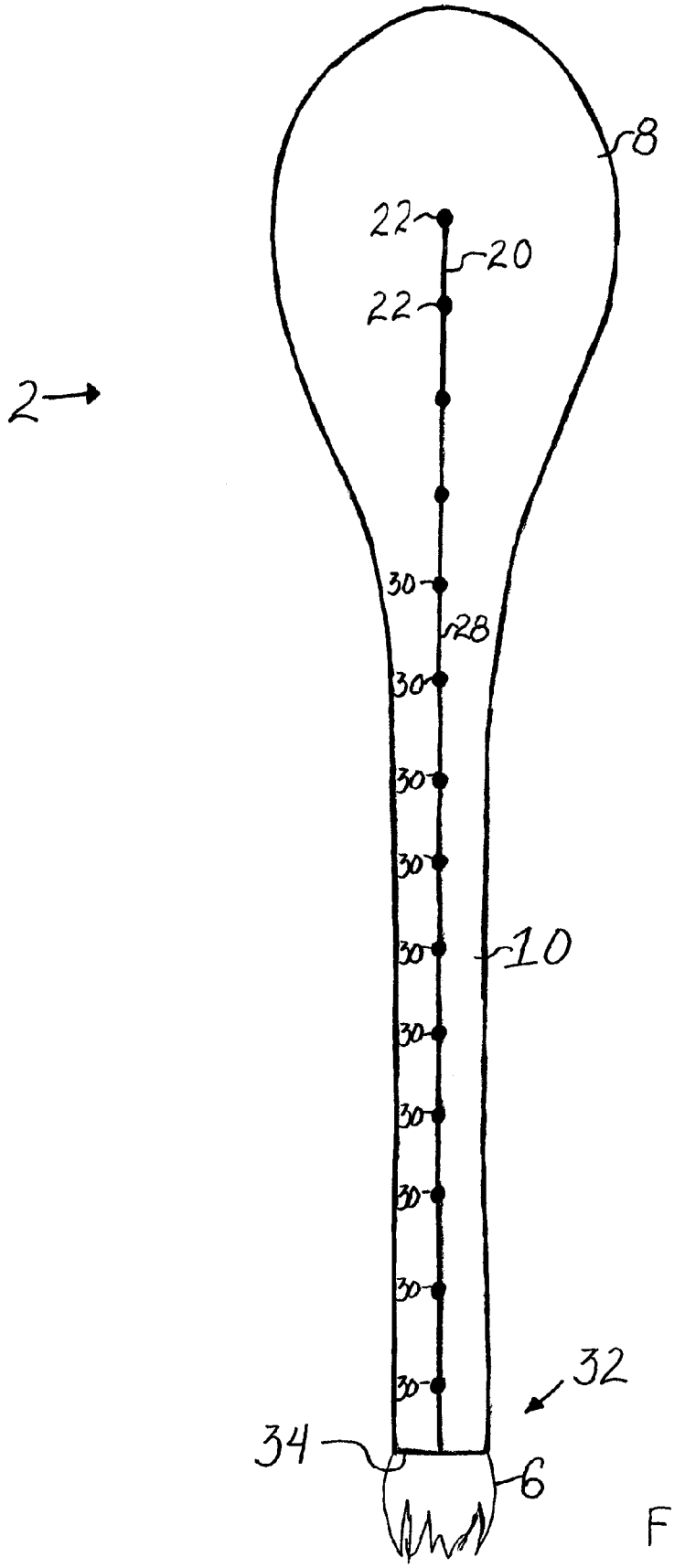
FIG. 4 is a rear view of the headwear garment of FIG. 1.

FIG. 4 illustrates a rear view of headwear garment 2. In one embodiment, longitudinal opening 20 is formed in head covering 8 opposite open side 12 of head covering 8. Longitudinal opening 20 allows wearer's hair 6 to be more easily positioned within headwear garment 2.

In one embodiment, head covering 8 further includes fasteners 22 for releasably fastening longitudinal opening 20 of head covering 8. Fasteners 22 may be any type of fastener, such as hook and loop, snaps, buttons, or ties.

Referring again to FIG. 3, hair retaining sleeve 10 is a sleeve of any length suitable for use in retaining wearer's hair 6. Hair retaining sleeve 10 has a proximal end 24 with opening or second opening 26 formed therein. Sleeve 10 is affixed to head covering 8 and positioned to align opening 26 with channel 18 through inner 14 and outer 16 surfaces of head covering 8. When head covering 8 is worn by wearer 4, wearer's hair 6 is able to be passed through channel 18 and into sleeve 10 through opening 26.

In one embodiment, opening 26 in proximal end 24 of hair retaining sleeve 10 is coincident with channel 18 through inner 14 and outer 16 surfaces of head covering 8. The coincidence of opening 26 with channel 18 allows wearer's hair 6 to be more easily able to be passed through channel 18 and into sleeve 10 through opening 26.

In one embodiment, sleeve 10 is integral with and extends from head covering 8. Although this embodiment is illustrated in FIGS. 1, 3, 4, and 5, integration of sleeve 10 with head covering 8 is not necessary to the function and purpose of this invention.

In one embodiment, longitudinal opening 28 is formed in hair retaining sleeve 10. Longitudinal opening 28 allows wearer's hair 6 to be more easily positioned within headwear garment 2.

In one embodiment, hair retaining sleeve 10 further includes fasteners 30 for releasably fastening longitudinal opening 28 of sleeve 10. Fasteners 30 may be any type of fastener, such as hook and loop, snaps, buttons, or ties.

In one embodiment, hair retaining sleeve 10 further includes distal end 32 having an opening or third opening 34 formed therein. Opening 34 allows a portion of wearer's hair 6 to be positioned outside of hair retaining sleeve 10.

Referring again to FIG. 1, in one embodiment, headwear garment 2 further includes a face cover 36 fastenable to head covering 8. Face cover 36 provides protection from wind and other environmental conditions encountered by wearer 4.

In one embodiment, headwear garment 2 further includes bill 38 affixed to head covering 8. Bill 38 may be decorative or functional to provide protection to wearer 4 from sun glare.

Figure 5:
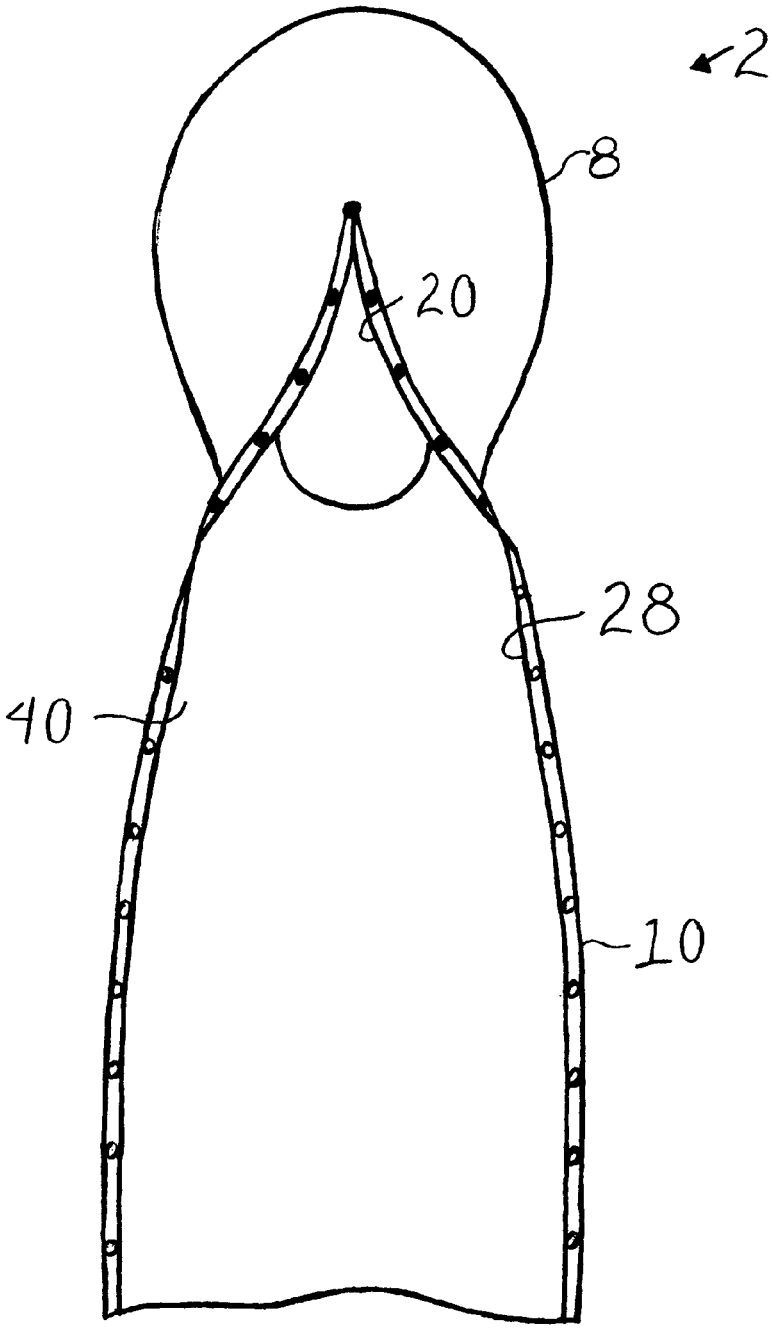
FIG. 5 is a rear view of the headwear garment of FIG. 1, shown opened along longitudinal openings.

FIG. 5 illustrates a rear view of headwear garment 2, open along longitudinal openings 20 and 28. Inner surface 40 of retaining sleeve 10 is shown.

The foregoing description is only illustrative of the invention and not intended to be exhaustive or to limit the invention to the precise forms disclosed. Various alternatives and modifications can be devised by those skilled in the art without departing from the invention. Accordingly, the present invention embraces all such alternatives, modifications, and variances that fall within the scope of the appended claims.

What is claimed is:

1. A headwear garment for retaining a wearer's hair, the headwear garment comprising:

a head covering having a first opening on one side for allowing a wearer to wear the head covering by placing the wearer's head through the first opening;

the head covering having inner and outer surfaces whereby the wearer's head is in proximity to the inner surface when the headwear garment is being worn by the wearer;

a channel formed through the inner and outer surfaces on a second side of the head covering opposite the first opening;

a hair retaining sleeve being generally cylindrical in shape and having a distal end and a proximal end, the proximal end having a second opening formed therein, and the distal end having a third opening formed there through;

the proximal end of the sleeve affixed to the head covering and positioned to align the second opening with the channel through the inner and outer surfaces of the head covering, wherein when the head covering is worn by a wearer, the wearer's hair is able to be passed through the channel in the head covering and into the sleeve through the second opening;

the sleeve having a longitudinal opening extending along an entire length of the sleeve between the distal end and the proximal end, the longitudinal opening allowing the wearer's hair to be accessed and positioned within the sleeve while the headwear garment is being worn by the wearer: and a plurality of fasteners attached to the sleeve and positioned to allow for at least partial opening and closing of the longitudinal opening,

2. The headwear garment of claim 1 wherein the second opening in the proximal end of the hair retaining sleeve is approximately the same size and shape as the channel through the inner and outer surfaces of the head covering.

3. The headwear garment of claim 1 wherein the sleeve is removably affixed to the head covering.

4. The headwear garment of claim 1 further comprising a size adjuster that permits the size of the head covering to be adjusted so that it fits the wearer.

5. The headwear garment of claim 1 wherein the plurality of fasteners can be partially unfastened to allow the longitudinal opening to be partially opened.

6. The headwear garment of claim 1 further including a face cover fastenable to the head covering.

7. The headwear garment of claim 1 further including a bill affixed to the head covering.

8. The headwear garment of claim 1 wherein the distal end of the hair retaining sleeve further includes an opening formed therein.

9. The headwear garment of claim 1 further comprising a size adjuster that permits the size of the head covering to be adjusted so that it fits the wearer and wherein:

the second opening in the proximal end of the hair retaining sleeve is approximately the same size and shape as the channel through the inner and outer surfaces of the head covering;

the sleeve is removably affixed to the head covering; and the hair retaining sleeve and the head covering together form a continuous tubular receptacle for the head and hair from the distal end of the sleeve to the open side of the head covering.

* * * * *